US005100026A

United States Patent [19]

Farrell

[11] Patent Number: 5,100,026

[45] Date of Patent: Mar. 31, 1992

[54] COLLAPSIBLE CONTAINER APPARATUS FOR USE IN THE STORAGE AND TRANSPORTATION OF FLUID MATERIAL

[75] Inventor: Peter J. Farrell, Beckenham, England

[73] Assignee: Concertainer Limited, Worcester, England

[21] Appl. No.: 531,320

[22] Filed: May 31, 1990

[30] Foreign Application Priority Data

Jul. 7, 1989 [GB] United Kingdom ..... 8915650

[51] Int. Cl.[5] ..... B65D 88/20; B65D 35/28

[52] U.S. Cl. ..... 222/95; 222/105; 222/181; 222/183

[58] Field of Search ..... 222/92-107, 222/386.5, 130, 131, 181, 183, 185

[56] References Cited

U.S. PATENT DOCUMENTS 2,858,051 10/1958 Cunningham ..... 222/105 X
3,058,623 10/1962 Hawk et al. ..... 222/95
4,092,051 5/1978 D'Orazio ..... 222/105 X
4,449,646 5/1984 Bonerb et al. ..... 222/95
4,722,655 2/1988 Bonerb ..... 222/105 X
4,861,215 8/1989 Bonerb ..... 222/386.5 X
4,907,723 3/1990 Katz ..... 222/105

FOREIGN PATENT DOCUMENTS 2189773 11/1987 United Kingdom ..... 222/105

*Primary Examiner*—Michael S. Huppert
*Assistant Examiner*—Kenneth DeRosa
*Attorney, Agent, or Firm*—Iandiorio & Dingman

[57] ABSTRACT

Collapsible container apparatus (2) for the storage and transportation of fluid material, which collapsible container apparatus (2) comprises a collapsible outer bag (4), a rigid top portion (15) which is attached to sides (12) of the outer bag (4), a rigid base (16), horizontally extending constraint members (20) and elongate support members (22), the outer bag (4) having a discharge aperture (72), and the collapsible container apparatus (2) further including an auxiliary discharge member (108) for raising a part of the outer bag (4) opposite the discharge aperture (72) in order to cause the discharge aperture (70) to be at the lowest part of the outer bag (4) for complete discharging of the fluid material.

9 Claims, 3 Drawing Sheets

COLLAPSIBLE CONTAINER APPARATUS FOR USE IN THE STORAGE AND TRANSPORTATION OF FLUID MATERIAL

This invention relates to collapsible container apparatus for the storage and transportation of fluid material such for example as liquids, powders and granular materials.

Collapsible container apparatus for the storage and transportation of fluid material is known, for example from our UK Patent No. 2189773. The collapsible container apparatus may be such that it is not possible for end users of the container apparatus easily to obtain the last small amount of fluid material in the collapsible container apparatus, due to the fact that the fluid material is usually discharged at a point slightly above the bottom of the collapsible container apparatus.

It is an aim of the present invention to obviate or reduce the above mentioned problem.

Accordingly, this invention provides collapsible container apparatus for the storage and transportation of fluid material, which collapsible container apparatus comprises an outer bag which has a bottom and sides and which is made from a flexible material so that the outer bag is collapsible, a rigid top portion which is attached to the sides of the outer bag, a rigid base, horizontally extending constraint members which are for constraining the sides of the outer bag when the collapsible container apparatus is in use and contains the fluid material, and elongate support members which are positioned adjacent the sides of the outer bag, the elongate support members being such that they are movable from a first position in which they extend between the rigid top portion and the rigid base to hold the rigid top portion firm with respect to the rigid base. to a second position in which they allow the sides of the outer bag to collapse by folding between the constraint members, the outer bag being such that it is not attached to the rigid base, the outer bag having a single discharge means which is located above the bottom of the outer bag, and the collapsible container apparatus further including auxiliary discharge means for raising a part of the outer bag opposite the discharge means in order to cause the discharge means to be at a lowest part of the outer bag when the container apparatus in in use whereby any fluid material remaining in the collapsible container apparatus is discharged through the discharge means; the auxiliary discharge means comprising flexible elongate member connected to a single bottom portion of the outer bag and which passes through an anchor member on the rigid top portion such that pulling on the flexible elongate member causes the flexible elongate member to slide through the anchor member and raise the bottom portion of the outer bag, and the anchor member being positioned on one side of the collapsible container apparatus and opposite the discharge means whereby the bottom portion of the outer bag is raised adjacent said one side of the collapsible container apparatus, and whereby the discharge means is moved across the rigid base towards said one side of the collapsible container apparatus thereby to tilt the bottom of the outer bag towards the discharge means such that the bottom of the outer bag is formed into a funnel shape which leads to the discharge means.

The use of the auxiliary discharge means thus provides a convenient way of obtaining the last amount of fluid material that may be remaining in the collapsible container apparatus. The rigid top portion may be sealed when the collapsible container apparatus is to be used with toxic or hazardous fluid materials, or the rigid top portion may be openable when the collapsible container is to be used for non-toxic fluid materials. In either case, the auxiliary discharge means can easily be operated to enable the last amount of the fluid material to be obtained.

The flexible elongate member may be a strap. Other types of flexible elongate member such for example as a cord may be employed.

The anchor member may be a loop member. Other constructions for the anchor member may be employed.

The auxiliary discharge means may include a strain-taking member which is connected to the lowermost one of the constraint members and to which the flexible member is also connectible.

The strain-taking member may be a loop member. Other constructions for the strain-taking member may be employed.

Preferably, the collapsible container apparatus includes a liner bag for containing the fluid material. The container apparatus may however be manufactured and sold without the liner bag if desired and, in this case, firms handling the fluid material may provide their own liner bags. Alternatively, the fluid material may be placed directly into the outer bag.

The type of discharge means employed for the outer bag will usually vary in dependence upon whether or not the liner bag is employed. Without a liner bag, then the discharge means will usually be a discharge device having a closeable opening. With a liner bag, the discharge means will usually be a simple hole through which projects a discharge device attached to the liner bag. The discharge device attached to the liner bag will then preferably be a discharge device having a closeable opening.

The various other parts of the collapsible container apparatus may be as shown in our U.K. Patent No. 2189773. Thus, for example, the outer bag will preferably define a square or a rectangle, and the rigid base will preferably be in the form of a pallet.

Usually, the collapsible container apparatus will have an access opening in the rigid top portion for enabling the fluid material to be introduced into the container apparatus.

Preferably, the elongate support members are movable about hinge means. The hinge means are preferably such as to secure the elongate support members to the rigid base.

An embodiment of the invention will now be described solely by way of example and with reference to the accompanying drawings in which.

Figure 1:
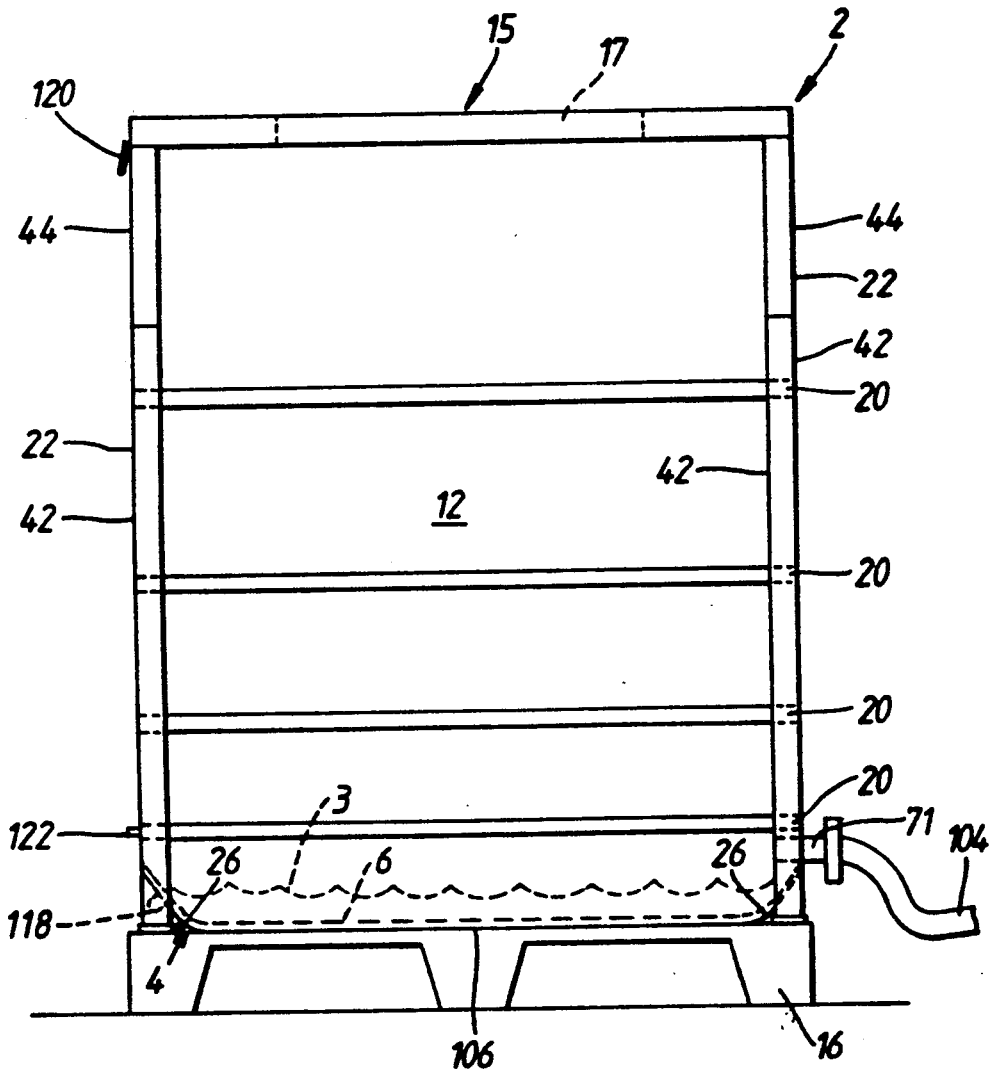
FIG. 1 is a side view of collapsible container apparatus in a normal discharge condition.
Figure 2:
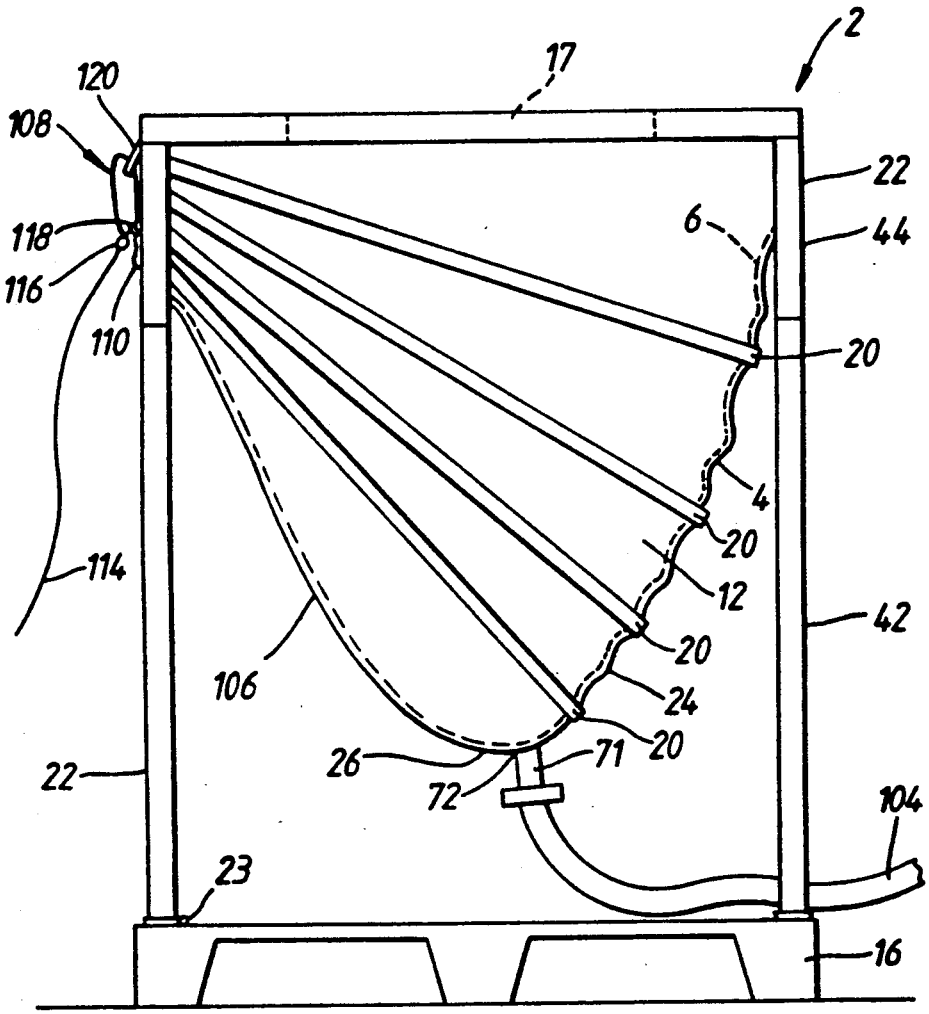
FIG. 2 is a side view of the apparatus shown in FIG. 1 but in a position in which auxiliary discharge means is being used.
Figure 3:
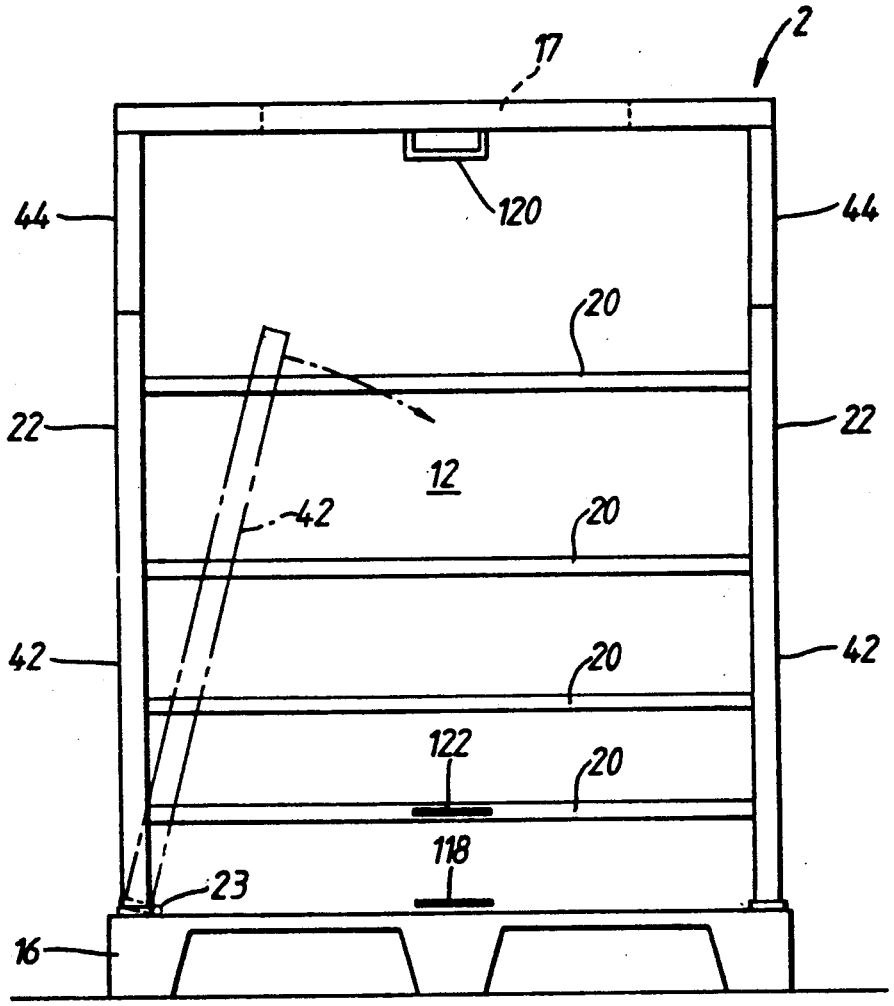
FIG. 3 is a front view of the apparatus as shown in FIG. 1 but without a strap forming part of the auxiliary discharge means.

For ease of understanding, FIGS. 1 to 3 have been shown in a somewhat simplied form and details of parts of the collapsible container apparatus not central to the present invention have been omitted and they can be seen in more detail in the drawings of our UK Patent No. 2189773.

In FIGS. 1 to 3 of the accompanying drawings, there is shown collapsible container apparatus 2 for the storage and transportation of fluid material 3. The collapsible container apparatus 2 comprises an outer bag 4 and a liner bag 6. The liner bag 6 contains a fluid material.

The outer bag 4 has a bottom 7 and four sides 12. The outer bag 4 is made of a flexible material so that it is collapsible. Any suitable and appropriate type of flexible material may be employed including plastics and fabric materials. The liner bag 6 is also made of a flexible material. Preferably, the liner bag 6 is made of a plastics material such for example as polyethylene.

The collapsible container apparatus 2 further comprises a rigid top portion 15, and a rigid base which is in the form of a pallet 16. The rigid top portion 15 has an access opening 17 for enabling the fluid material to be introduced into the liner bag 6 when it is positioned in the collapsible container apparatus 2 and when the collapsible container apparatus 2 is in its collapsed position. The access opening may be closed by a hinged lid but the access opening is preferably closed by a removable panel part of the rigid top portion 15.

The collapsible container apparatus 2 further comprises horizontally extending constraint members 20 for constraining the sides 12 of the outer bag 4 when the collapsible container apparatus 2 is in use.

The collapsible container apparatus 2 further comprises four elongate support members 22 which are positioned on the outside of the sides 12 of the outer bag 4 such that one of the elongate support members 22 is provided adjacent each corner 24 formed by the sides 12 of the outer bag 4. The elongate support members 22 are such that they are each movable about a high 23 from a first position as shown in FIGS. 1 to 3 in which they extend between the rigid top portion 15 and the pallet 16 to hold the rigid top portion 15 firm with respect to the pallet 16, to a second position see FIG. 3 in which they allow the sides 12 of the outer bag 4 to collapse.

As shown in FIGS. 1 to 3, the sides 12 of the outer bag 4 define a square but they may define a rectangle if desired. The sides 12 may be of any desired height, so that generally the outer bag 4 may be of any desired size. Obviously, the liner bag 6 will be of a size appropriate to the size of the outer bag 4. The liner bag 6 will usually be slightly larger than the size of the outer bag 4 in order to ensure that the liner bag 6 is always supported by the outer bag 4.

As can be seen from FIG. 1, the sides 12 of the outer bag 4 are curved inwardly at their lower ends to define convex portions 26 adjacent the pallet 16. As can be seen from FIG. 2, the outer bag 6 is not secured to the pallet 16.

The ribs 20 are located in elongate covers (not shown) which are made of a plastics material such for example as polyvinyl chloride and which are secured, for example by welding, to the sides 12 of the outer bag 4. As an alternative to welding, stitching or other fastener means may be employed.

Each elongate support member 22 comprises a first part 42 which is separable from a second part 44. A detailed construction of the elongate support members 22 is as described in UK patent No. 2189773.

The liner bag 6 has a discharge outlet 71 which extends through a discharge aperture 72 in the outer bag 4. The discharge outlet 71 is connected to a discharge pipe 104. The discharge outlet 71 is in the form of a valve which has an opening in a body portion, and a closure member for closing the opening. The discharge aperture 72 in the outer bag 4 is a simple hole.

The discharge outlet 71 in the liner bag 6 is located above the bottom of the liner bag 6. Thus, normally, it is not possible to drain off the last amount of the fluid material in the liner bag 6. If it is desired to obtain this last amount of the fluid material in the liner bag 6, then auxiliary discharge means 108 may be employed.

The auxiliary discharge means 108 is for pulling up a part 110 of the outer bag 4 opposite the discharge aperture 72 in order to cause the discharge outlet 71 of the liner bag 6 to be at the lowest part of the liner bag 6. By this means, the fluid material 3 normally remaining in the liner bag 6 as shown in FIG. 1 can be discharged through the discharge outlet 71 and the discharge pipe 104 as shown in FIG. 2.

The auxiliary discharge means 108 comprises a flexible elongate member in the form of a strap 114 which is provided with a buckle member 116. The strap 114 is connectible to a bottom 106 of the outer bag 4. The strap 114 is connected to a loop member 118 on the bottom 106. The loop member 118 may be made of a flexible material or a rigid material such as a metal.

The strap 114 also passes through an anchor member in the form of a loop member 120 on the rigid top portion 15. Thus, pulling on the strap 114 causes the strap 114 to slide through the loop member 120 and raise the bottom 106 in order to discharge the fluid material 3 remaining in the liner bag 6. Thus, the strap 114 is effective to raise a part of the outer bag 4 and thereby to raise a corresponding part of the liner bag 6.

The auxiliary discharge means 108 further includes a strain-taking member in the form of a loop member 122. The loop member 122 is connected to the lowermost one of the constraint members 20. The strap 114 passes through the loop member 122. The loop member 122 helps to take the strain off the loop member 118.

The auxiliary discharge means 108 is such that the raised part of the outer bag 4 and the liner bag 6 can be secured in the raised position until the last amount of the fluid material has been discharged.

It is to be appreciated that the embodiment of the invention described above with reference to the accompanying drawings has been given by way of example only and that modifications may be effected. Thus, for example, a cord or a cable instead of a strap 114 could be employed. The strap 114 or other elongate flexible member employed will usually be removable from the remainder of the collapsible container apparatus 2, but it may be made as a fixture to the remainder of the collapsible container apparatus 2 if desired. As an alternative to the illustrated auxiliary discharge means, a pulley system or a counter-weight balance system may be employed. Further, the liner bag 6 may be dispensed with, in which case, the fluid material 3 may be placed directly in the outer bag 4. In this case, the outer bag 4 will be provided with a discharge opening having a discharge device similar to that shown for the liner bag 6.

I claim:

1. Collapsible container apparatus for the storage and transportation of fluid material, which collapsible container apparatus comprises an outer bag which has a bottom and sides and which is made from a flexible material so that the outer bag is collapsible, a rigid top portion which is attached to the sides of the outer bag, a rigid base, horizontally extending constraint members which are for constraining sides of the outer bag when the collapsible container apparatus is in use and contains the fluid material, and elongate support members which are positioned adjacent the sides of the outer bag, the elongate support members are movable from a first position in which said elongate support member extend between the rigid top portion and the rigid base to hold the rigid top portion firm with respect to the rigid base, to a second position in which said elongate support member allow the sides of the outer bag to collapse by folding between the constraint members, the outer bag is not attached to the rigid base, the outer bag having a single discharge means which is located above the bottom of the outer bag, and the collapsible container apparatus further including auxiliary discharge means for raising a part of the outer bag opposite the discharge means in order to cause the discharge means to be at a lowest point of the outer bag when the container apparatus is in use whereby any fluid material remaining in the collapsible container apparatus is discharged through the discharge means, the auxiliary discharge means comprising a flexible elongate member connected to a single bottom portion of the outer bag and which passes through an anchor member on the rigid top portion such that pulling on the flexible elongate member causes the flexible elongate member to slide through the anchor member and raise the bottom portion of the outer bag, and the anchor member being positioned on one side of the collapsible container apparatus and opposite the discharge means whereby the bottom portion of the outer bag is raised adjacent said one side of the collapsible container apparatus and whereby the discharge means is moved across the rigid base towards said one side of the collapsible container apparatus thereby to tilt the bottom of the outer bag towards the discharge means such that the bottom of the outer bag is formed into a funnel shape which leads to the discharge means.

2. Collapsible container apparatus according to claim 1 in which the flexible elongate member is a strap.

3. Collapsible container apparatus according to claim 1 in which the anchor member is a loop member.

4. Collapsible container apparatus according to claim 1 in which the auxiliary discharge apparatus includes a strain-taking member which is connected to the lowermost one of the constraint members and to which the flexible member is also connectible.

5. Collapsible container apparatus according to claim 4 in which the strain-taking member is a loop member.

6. Collapsible container apparatus according to claim 1 and including a liner bag for containing the fluid material.

7. Collapsible container apparatus according to claim 1 and including an access opening in the rigid top portion for enabling the fluid material to be introduced into the collapsible container apparatus.

8. Collapsible container apparatus according to claim 1 in which the support members are movable about hinge means.

9. Collapsible container apparatus according to claim 8 in which the hinge means are such as to secure the elongate support members to the rigid base.

* * * * *